US007056205B2

(12) United States Patent
Odom et al.

(10) Patent No.: US 7,056,205 B2
(45) Date of Patent: Jun. 6, 2006

(54) ELECTRONIC CARD GAME AND METHOD

(75) Inventors: Wayne Odom, Las Vegas, NV (US); Karolyn Gee, Las Vegas, NV (US)

(73) Assignee: Karaway Gaming, Inc, Tucson, AZ (US)

( * ) Notice: Subject to any disclaimer, the term of this patent is extended or adjusted under 35 U.S.C. 154(b) by 665 days.

(21) Appl. No.: 09/977,138

(22) Filed: Oct. 12, 2001

(65) Prior Publication Data

US 2002/0103017 A1 Aug. 1, 2002

Related U.S. Application Data

(60) Provisional application No. 60/241,644, filed on Oct. 19, 2000.

(51) Int. Cl.
*A63F 9/24* (2006.01)

(52) U.S. Cl. ..... 463/13

(58) Field of Classification Search ..... 463/11–13, 463/16–18; 273/138.1, 292
See application file for complete search history.

(56) References Cited

U.S. PATENT DOCUMENTS 5,042,809 A * 8/1991 Richardson ..... 463/18
5,630,753 A * 5/1997 Fuchs ..... 463/9
5,868,619 A 2/1999 Wood et al.
5,876,283 A * 3/1999 Parra et al. ..... 463/12
5,882,258 A * 3/1999 Kelly et al. ..... 463/11
5,967,894 A * 10/1999 Kinoshita et al. ..... 463/13
6,062,979 A * 5/2000 Inoue ..... 463/12
6,129,631 A * 10/2000 Hundal et al. ..... 463/11
6,131,906 A * 10/2000 Green ..... 273/148 R
6,248,016 B1 6/2001 Walker et al.
6,270,405 B1 8/2001 Ferguson
6,299,531 B1 * 10/2001 Bommarito ..... 463/12
6,343,989 B1 * 2/2002 Wood et al. ..... 463/23
6,533,658 B1 * 3/2003 Walker et al. ..... 463/13
6,537,150 B1 * 3/2003 Luciano et al. ..... 463/16

* cited by examiner

*Primary Examiner*—Kim Nguyen
(74) *Attorney, Agent, or Firm*—Robert Ryan Morishita; Morishita Law Firm, LLC

(57) ABSTRACT

A method and device is set forth for playing a game where an inventory of data representing playing cards is arranged in a random but established, serial order. For each hand of play the player makes a wager and cards are displayed, according to the rules of the game, in order from the inventory to define a winning or losing outcome. A display, as hands are played, displays the remaining constituency of the inventory and the player, before any hand, can order re-shuffling and re-constitute of the inventory. Further, re-shuffling may be triggered by a card or hand count or certain pre-defined triggers.

47 Claims, 4 Drawing Sheets

ELECTRONIC CARD GAME AND METHOD

CROSS REFERENCE TO RELATED APPLICATION

This application is a continuation-in-part application of commonly owned application Ser. No.: 60/241,644 filed Oct. 19, 2000 and titled "Electronic Video Poker and Game".

FIELD OF THE INVENTION

The present invention relates to methods and devices for playing electronic video Poker, Blackjack and other card games.

BACKGROUND

Video Poker is a well known game played using and electronic device such as computer with a display, a hand-held device or with a dedicated, video Poker gaming machine. In that the play of basic video Poker is the same whether it is played with a hand held, electronic novelty device, with a computer, through the Internet or with a dedicated gaming machine, the following description is primarily directed to a dedicated, video Poker gaming or video lottery machine of the type found in casinos.

To play the game according to the prior art, the player makes a wager by any suitable means such as by wagering credits, inserting tokens or the like. Once the wager is made the machine is prompted for play whereupon the processor for machine randomly selects from data representing a deck of playing cards, data representing ten playing cards. This data need is not arranged in any order and typically is configured as a data string representing the cards of the deck in no particular order. This order is fixed when the data string is constructed; however the random selection from the string makes the fixed order, at least to a degree, irrelevant. From this randomly selected data, five playing cards are displayed representing the initial holding and the data for the remaining ten cards is held in inventory. The player, using a touch screen on the game display or buttons on the machine, selects which cards to discard, if any, from the initial holding. The data representing the discarded cards is replaced with the inventoried data and the replacement cards are displayed. The final hand is (with or without replacement cards) is compared to a schedule of winning hands based on the ranking of hands of Poker. If the player has a winning final hand, they are paid based upon their wager. If they do not have a winning hand, their wager is lost. After determination of the outcome of the hand, the player makes another wager and plays the next hand according to the above.

For each new hand of play, the initial hand is selected from data representing a full deck of cards. This deck may have the standard fifty-two cards or may include an additional, wild, Joker. In this regard, it is further known to provide games according to the above based upon a deuces wild, Joker's wild and Joker's and deuces wild format. The play of a hand does not deplete the deck data stored for the next hand. It follows that the device does not track nor display cards remaining in the deck since there is no deck depletion as hands are played. Further there is no means for the player to select to "reshuffle" or not reshuffle after a series of hand since, according to the prior art, each hand is dealt from a full deck.

Video Blackjack is also a known game. According to this game, the player makes a wager and data representing a two card player hand and two card dealer hand are randomly selected and displayed from a full deck of fifty-two cards. The cards of the player hand are revealed whereas only one card of the dealer hand is shown. The player, using an input device, opts to stand, split, double down and take one or more hits to complete his hand according to the rules of the game. The dealer's hand is then revealed and completed. As between the dealer and player, the one having a hand count at or closest to "21" wins the hand. After the hands are completed and compared and any wager paid or collected, a new wager is made and cards are dealt from a fully constituted deck.

For the table game version of Blackjack, a series of hands are dealt from a deck and the deck is depleted to a point where the deck is re-shuffled.

Baccarat is another known game where a deck of cards is shuffled to configure the cards into a random, serial order and where multiple hands are dealt from the deck before a point is reached in penetration through the deck where the deck is re-shuffled.

Further, in regards to deck depletion through a series of hands for the play of games of the type described, the same does not occur with respect to electronic card games since the deck is fully constituted at the start of each hand. Further, where a deck is depleted over a series of hands, it is against conventional wisdom to display to players the remaining constituency of the depleted deck so they can see the cards available for play. In most jurisdictions, card counting, e.g. a player determining the remaining cards in the deck based upon the cards played (in Blackjack where multiple rounds of hands are played from a deck of cards) is a crime or a basis for ejecting the player from the casino.

There is a need for a game and method wherein, at least for a plurality of hands of play, the cards which have been played deplete the deck for the succeeding hand. There is also a need for a game and method wherein the processor tracks the cards which have been played and therefore can determine and display, if desired, the inventory of cards remaining in the deck for play of the next hand. Still further there is a need for a game where the player can order "reshuffling" if he/she desires. Further there is a need for a game of the type described above where re-shuffling of the deck data, if not ordered by the player, is required based upon one or more pre-selected triggers.

SUMMARY OF THE INVENTION

There is, therefore, set forth according to the present invention, a method and electronic device for playing a card game such as a Video Poker game where the deck(s) are randomized (shuffled) into a random, serial order 1-N, where cards for play are selected and displayed in serial order for the deck, where the constituency of the deck. i.e. the remaining cards available for play, are displayed and where the deck is reconstituted and reconfigured into a new, random, serially arranged deck of N cards based upon the count of displayed cards, a command prompt by the player or a pre-determined trigger and where the displayed pay table may be reconfigured to reflect the fact that, based upon depletion of the deck, certain winning outcomes cannot obtained.

Toward this end there is set forth a method and device for playing a card game such as a Video Poker game which includes providing a data processor including a first data structure storing data representing at least one deck of N playing cards according to the rules of the game. For example, for regular Poker, the first data structure would store data representing each card of a fifty-two card deck. In the first data structure the card data is configured a random, serial order representing a deck of shuffled cards. The player makes a wager and plays a series of hands. For each hand of play, data is selected from the first data structure and displaying at an electronic display data representing an initial holding of at least three playing cards, e.g. a five card Poker hand, the data selected in order from the serially arranged deck data. The player opts to discard one or more of said displayed playing cards of the initial holding, the processor for any discarded card selecting and displaying a replacement card selected in order for the serially arranged deck data to define a final outcome, five card, combination. The final card combination is compared to data stored in a second data structure storing data representing winning outcomes. If the player has obtained a winning outcome an award corresponding to a winning outcome is issued to the player.

The processor maintains data representing the constituency of the deck data remaining in the first data structure, e.g. how many Aces-Deuces are left, and displays the constituency of the deck data depleted of said displayed cards. Thus are cards are selected from the serially arranged deck and before the next hand of play, there is displayed for the player the remaining constituency of the deck which the player may use to guide their decisions as to which cards to discard.

The feature of displaying the remaining constituency of the deck through the play of a series of hands can also be incorporated into video versions of Blackjack, Baccarat and other games.

At a predetermined count of selected cards, the deck data is reconstituted and reconfigured such that the cards are randomly positioned in a serially ordered deck representing a re-shuffled deck. As new hands are played cards are selected in series form the deck data so as to correspond to dealing of cards from the top of the deck. Reconstitution and reconfiguration may also be triggered, as by the play of the Joker in Joker's Wild Poker or upon prompting by the player.

BRIEF DESCRIPTION OF THE DRAWINGS

These and other features and advantages will become appreciated as the same becomes better understood with reference to the description, claims and drawings wherein:

DESCRIPTION

Figure 1:
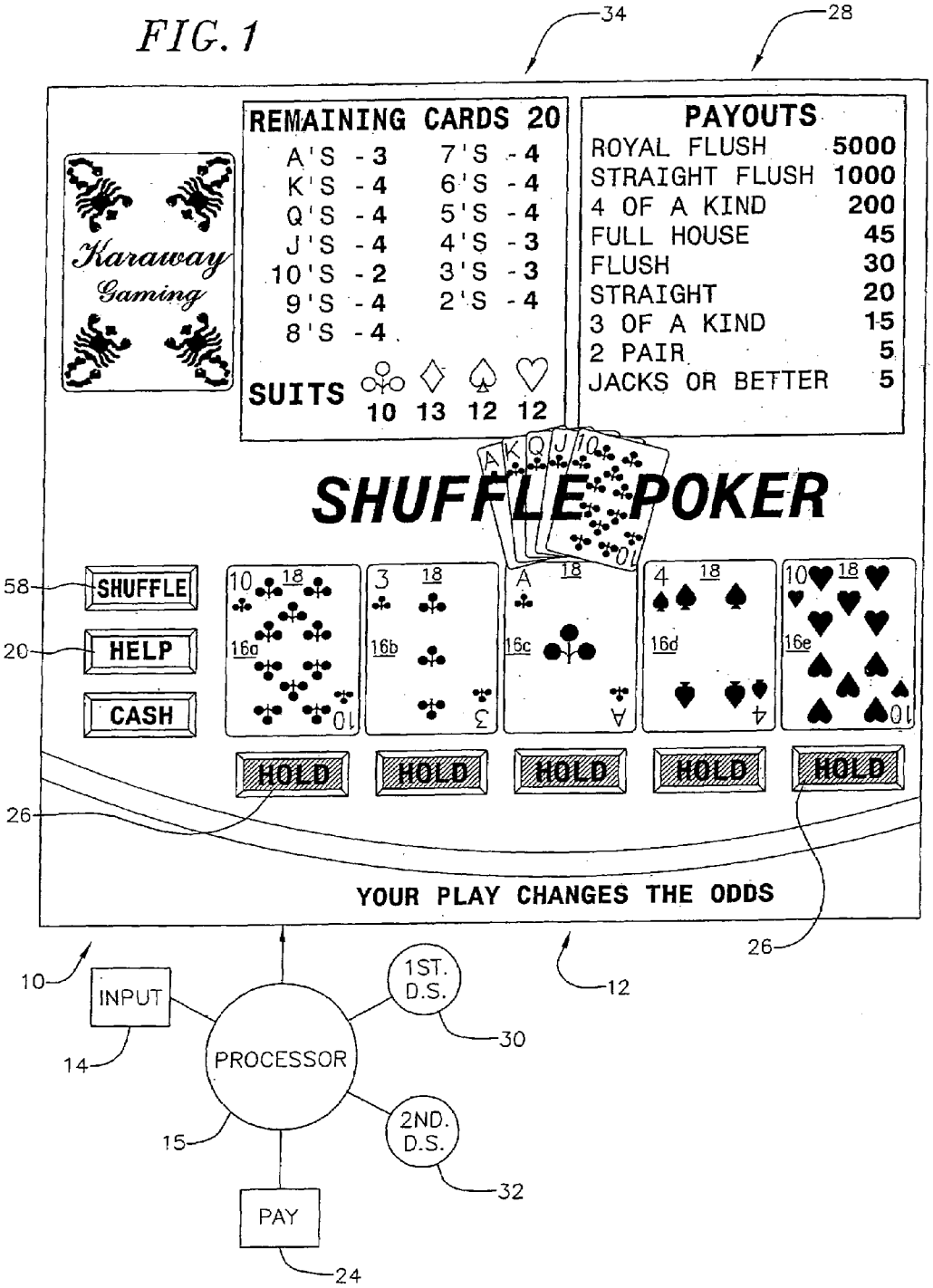
FIG. 1 shows a processor controlled display after the play of one hand of Video Poker.
Figure 2:
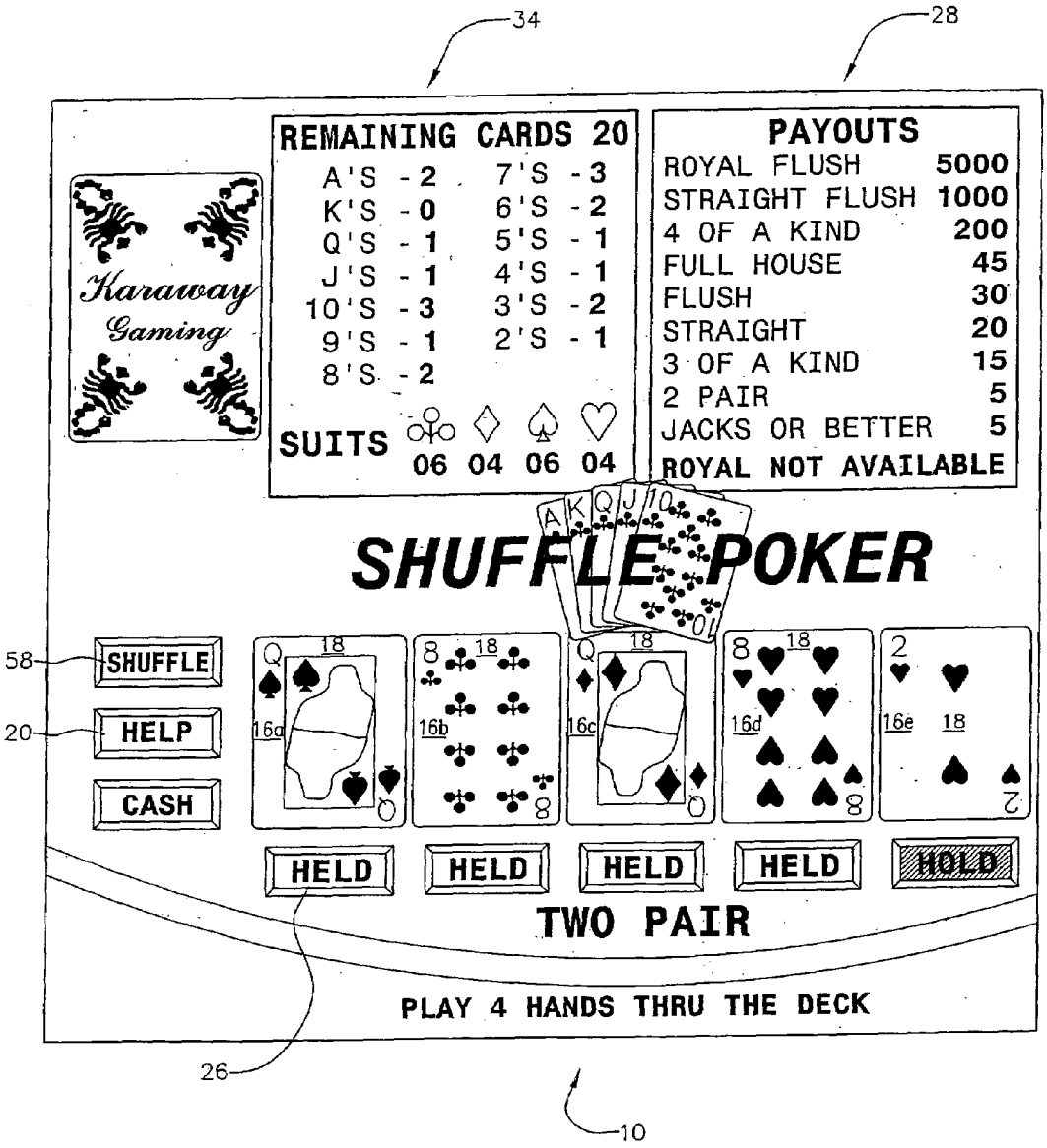
FIG. 2 shows the processor controlled display after the play of another hand of play of Video Poker.

Turning to the drawings, FIGS. 1 and 2 show an electronic display 10 for the game and method according to the present invention. The display 10 may be presented by a video display or plasma display for a gaming machine or on a computer monitor or handheld game display.

With reference to FIG. 1, a device 10 and method for the Video Poker embodiment of the present invention is shown. The device 10 includes an electronic video display 12 presenting an example of the layout for the play of the game. The device 10 may be incorporated into any platform such as those currently known in the art. For example, the display 12 may be a touch screen display including data input means 14 to control the game/machine processor 15; however it should be understood that other data input means could be used such as machine buttons, mouse, keyboard or the like.

The display 12 has a locations 16*a–e* for the display of the game hand cards 18 during play. During the play of the device 10 and method, cards 18 are displayed in a manner as hereinafter described to play the game method.

Not shown in FIGS. 1 and 2, the device 10 and/or display 12 may include a credit meter, as is known on the art, to keep a tally on the gaming credits available for play and means for the player to input a wager and prompt play of the game. For example, the device may include a cash reader or token acceptor by which the player may input the desired wager as well as input means to wager accumulated credits, agin as is known in the art.

To provide information to the player, the display 12 includes a touch screen help button 20 which, if touched by the player, prompts the processor 15 to display helpful information to the player. Also included is a cash out button 22 which if touched by the player prompts the processor 15 to operate a pay device 24 which may be a coin hopper device, voucher writer, credit or debit card writer or a program to transfer accumulated credits to the player's established account.

To enable the player to hold/discard cards 18, each location 16*a–e* has associated therewith a hold button 26. As is known in the play of Video Poker, if the player desires to hold a card 18, he/she touches the corresponding hold button 26 which prompts the processor 15 for the game to retain the display of the held card 18. Cards which are not held in the initial hand or holding, are replaced with replacement cards to define the final, outcome, holding. The final holding, as described below, is compared to an established pay table to determine if the player has a winning or losing outcome.

The processor 15 controls the display 12 to also display a pay table which lists winning outcomes and the pay for each. Data corresponding to winning combinations and the pay or award for each may be stored in a second data structure 32

Data representing the deck of N cards for play of the game is stored in a first data structure 30, such as a digital memory device. Where the deck is a single, standard deck, N=52 cards. The data is stored in a serial order, each address representing a playing card of the deck. Thus the data is stored in a fashion to replicate a shuffled deck of playing cards. That is, when newly shuffled for play, the card data is stored in the first data structure 30 as a sequential string of card data representing cards $N_1$–$N_{52}$. The cards in the addresses $N_1$–$N_{52}$ are not in any suit or value order but instead are randomized simulating a shuffled deck of cards, with the top card being $N_1$ and the bottom card being $N_{52}$. A random number generator may be used to randomly select cards for each address. Thus, to the processor 15 and first data structure 30, the data is arranged in a fashion similar to that of a shuffled deck of cards.

When the play of the game is prompted after shuffling (reconstitution and reconfiguration of the data), the processor 15 selects the first five addresses $N_1$–$N_5$ in the data structure defining the initial holding and, with that data, displays the corresponding cards at the display in locations 16*a–e* as shown in FIG. 1. The next card selected would be $N_6$. If, on the other hand, the last card displayed form the previous game was at address position $N_{20}$, the processor would access address positions $N_{21}$–$N_{25}$ and display the cards corresponding to those addresses. Of course other arrangements of data may be used to simulate the ordered, serial and random arrangement of cards in a shuffled deck.

The processor 15 controls the display 12 to display a table 34 which describe the inventory data representing cards of the first data structure 30. Table 34 is updated as card data is selected and cards displayed to impart information as to the remaining constituency of the data, i.e. how many of each card are left in the inventory.

Figure 3:
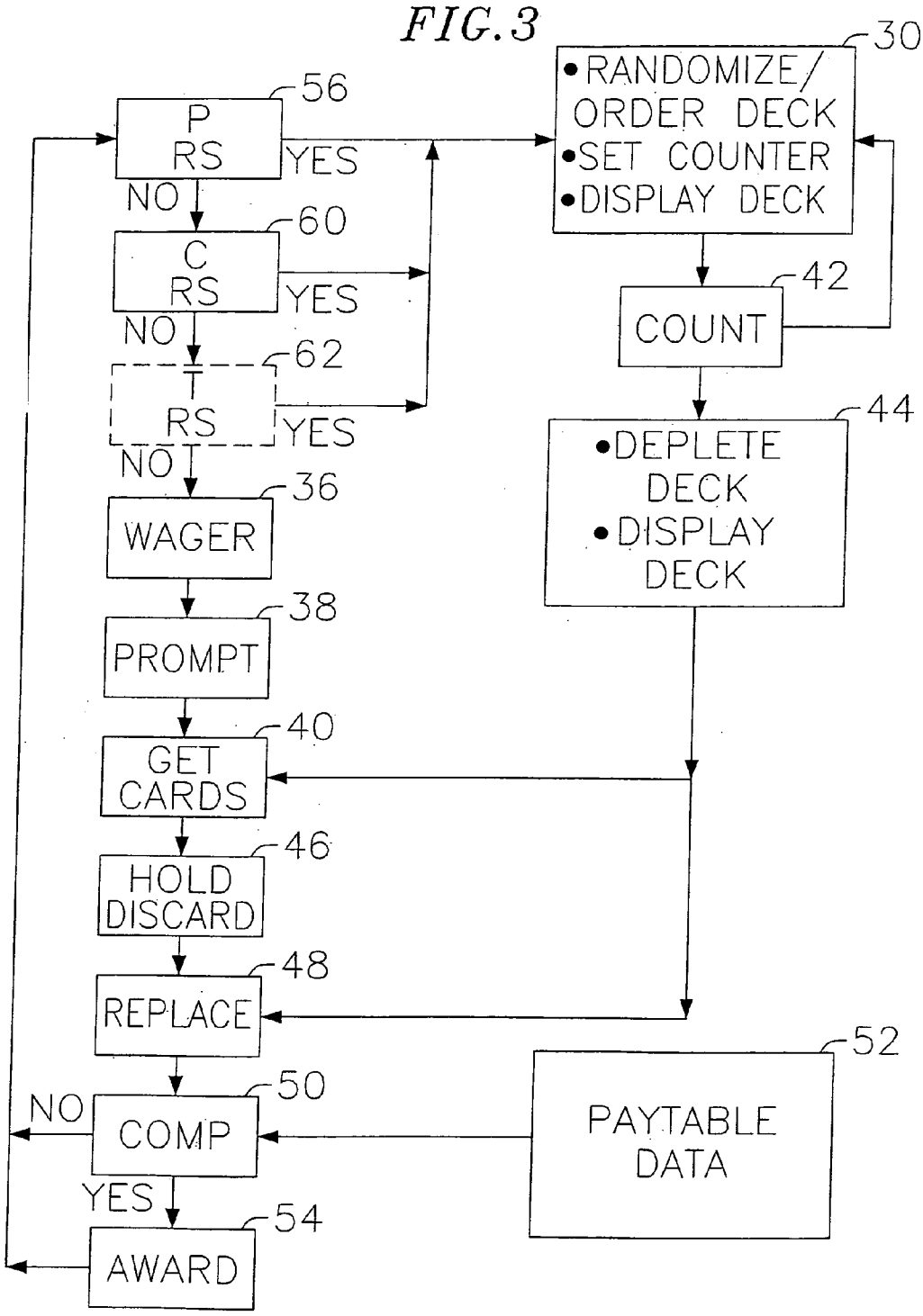
FIG. 3 illustrates a flowchart for the game of Video Poker.

With reference to FIGS. 1 and 3, the method of the play and the device 10 for Video Poker will now be described.

Video Poker

At 36 the player inputs their desired wager to play a hand of Video Poker and at 38 prompts the processor 15 for play. The processor 15 accesses the first data structure 30 to get the next cards 18 at 40 in order from the random, serially arranged, deck data. For purposes of discussion and with reference to FIG. 1, it is assumed that the deck data of the first data structure 30 has been re-randomized, reconstituted and serially ordered into data representing a complete shuffled deck of fifty-two cards $N_1$–$N_{52}$. Thus, at 40, the processor 15 gets cards $N_1$–$N_5$ and displays the same at the display 12 as an initial five card holding of, according to this example, 10♧3♧A♧4♤10♤ (FIG. 1).

With continuing reference to FIG. 3, the processor 15 also counts the number of cards which the current hand has depleted from the deck at 42 as well as accounts for the value, and if desired suit, of the cards remaining in the deck data inventory of the first data structure 30. Thus, if the deck data was a full deck of fifty-two cards of a standard deck of playing cards, the deck by the retrieval and display of five playing cards has been (1) depleted of five cards and (2) specifically depleted of cards 10♧3♧A♧4♤10♤. The processor re-tabulates the table 34 to account for the depletion of the deck. That is, before and after the display of the cards of the initial holding the table 34 would be altered as suggested below and as reflected in FIG. 1:

| Table Before Initial Deal | | Table After Initial Deal | |
|---|---|---|---|
| A's | 4 | **A's** | **3** |
| K's | 4 | K's | 4 |
| Q's | 4 | Q's | 4 |
| J's | 4 | J's | 4 |
| 10's | 4 | **10's** | **2** |
| 9's | 4 | 9's | 4 |
| 8's | 4 | 8's | 4 |
| 7's | 4 | 7's | 4 |
| 6's | 4 | 6's | 4 |
| 5's | 4 | 5's | 4 |
| 4's | 4 | **4's** | **3** |
| 3's | 4 | **3's** | **3** |
| 2's | 4 | 2's | 4 |
| | 52 | | 47 |

(Bold cards reflect deck constituency change)

Thus at 44 the processor depletes the deck data of the first data structure 30 and displays the remaining constituency of the card data so the player knows which cards remain available for selection and display.

With reference to FIG. 3, at 46 the player selects with the input means 14 which cards of the initial holding to hold. For example, with reference to FIG. 1 the player may decide to hold the 10's. Thus the display 12 would display the cards 18 in the following manner:

| | | | | |
|---|---|---|---|---|
| 10♧, Hold | 3♧, | A♧, | 4♤, | 10♤, Hold |

Upon the player prompting play, at 48 the processor 15 selects from the data stored in the first data structure the next data, e.g. $N_6$–$N_8$ and displays the same as replacements for the discarded cards 3♧A♧4♤. For example, the hand, after replacements may result in a final holding outcome of:

| | | | | |
|---|---|---|---|---|
| 10♧, Hold | 10♢, | J♧, | J♤, | 10♤ Hold |

This holding is a Full House.

In connection with the retrieval of the replacement card data, the processor at 44 depletes the deck data of the data representing the replacement cards (cards 10♢, J♧J♤) and displays at the display 12 at table 34 the new constituency of the deck depleted by the replacement card data. Thus the table 34 would be:

| Table After Initial Deal | | Table After Replacements | |
|---|---|---|---|
| A's | 3 | A's | 3 |
| K's | 4 | K's | 4 |
| Q's | 4 | Q's | 4 |
| J's | 4 | **J's** | **2** |
| 10's | 2 | **10's** | **1** |
| 9's | 4 | 9's | 4 |
| 8's | 4 | 8's | 4 |
| 7's | 4 | 7's | 4 |
| 6's | 4 | 6's | 4 |
| 5's | 4 | 5's | 4 |
| 4's | 3 | 4's | 3 |
| 3's | 3 | 3's | 3 |
| 2's | 4 | 2's | 4 |
| | 47 | | 44 |

(Bold cards reflect deck constituency change)

Thus the player has updated information as to the constituency of the remaining deck data.

At 50 the processor 15 compares the outcome to data stored in a second data structure 52 representing winning outcomes and the award for each (referred to herein as pay table data) to determine if the player is entitled to an award. If the player has obtained a winning outcome, at 54 the processor 15 issues the appropriate award. Typical pay table data for a five unit wager is as shown at the pay table 28 of FIG. 1. The pays may be linear based upon the tokens wagered or may include one or more higher pays to encourage a maximum coin wager.

After the award or if no award was won, the processor 15 determines at 56 if the player has prompted re-shuffling of the deck data of the first data structure 30. The player may prompt reconfiguration and reconstitution of the deck data of the first data structure into data representing a shuffled, random, serially ordered full deck by touching shuffle button 58 (FIG. 1). The processor 15 reconfigures and reconstitutes the deck data of the first data structure 30 into data representing cards $N_1$–$N_{52}$. The display 12 would also be controlled to show the constitution of the deck data at table 34. The player may command re-shuffling where the deck constitution, for the next hand of play, is not what the player desires, e.g. is completely depleted of Aces thus making a Royal Flush impossible for the next hand. It should be noted that where deck depletion makes certain outcomes impossible for the next hand, the processor 15 would re-configure the pay table 28 and remove that outcome. For example, if all Kings are depleted from the deck making a Royal Flush impossible, the Royal Flush pay would be removed from the pay table 28.

If the player does not command re-shuffling, re-shuffling may be commanded based upon the count of the card data which has been displayed. According to the preferred embodiment, where penetration into the deck data reaches a predetermine number, the processor 15 commands reconfiguration and reconstitution of the deck data. For example, if the count exceeds 30 cards, e.g. ($N_1$–$N_{31}$), at 60 the deck data is reshuffled before the play of the next hand.

Also one or more triggers at 62 may trigger re-shuffling and reconstitution of the deck. For example, where the game is a Joker's Wild version of Video Poker, the display of the Joker in the hand may trigger re-shuffling before the play of the next hand. Other triggers may be depletion of one of A's–10's from the deck (making a Royal Flush impossible) or depletion of all the 2's in a Deuces Wild format game.

Where re-shuffling takes place, the table 34 reflects the re-constitution of the deck.

Table 34 may also display the cards remaining for each suit as shown in FIG. 1.

Whether re-shuffling takes place or not, the player at 36 inputs another wager to play the next hand having the information imparted by the table 34 of the constitution of the deck data.

FIG. 2 illustrates the display 12 after completion of a hand which has depleted the deck data to have a remaining set of 32 cards. Since the next hand could require the selection and display of ten cards (initial holding of five cards where all are discarded and replaced) thereby exceeding a forty card deck penetration, re-shuffling of the deck data would occur prior to the play of the next hand.

As suggested above, the device and method can be configured to play a Deuces Wild or Joker's Wild game. For Joker's Wild, data is stored in the first data structure 30 representing a standard deck (52 cards) plus at least one Joker for data representing fifty-three cards. Preferably only one Joker is included and is "wild" to represent any card in the deck. For Joker's Wild the pay table data stored in the second data structure 32 represents the following winning combinations and awards for a five unit wager:

| | |
|---|---|
| Royal Flush (without Joker) | 5000 |
| 5 of a Kind | 1000 |
| Royal Flush with Joker | 500 |
| Straight Flush | 250 |
| 4 of a Kind | 100 |
| Full House | 35 |
| Flush | 25 |
| Straight | 15 |
| 3 of a Kind | 10 |
| Two pair | 5 |
| Pair of Queens or Better | 5 |

The processor 15 is programmed to order re-shuffling (reconfiguration and reconstitution) of the deck data upon the first of: (1) where the count the hands played as tracked by the counter 42 is four hands (2) after a hand is played including the Joker, or (3) player commanded re-shuffling.

Blackjack/Baccarat

Figure 4:
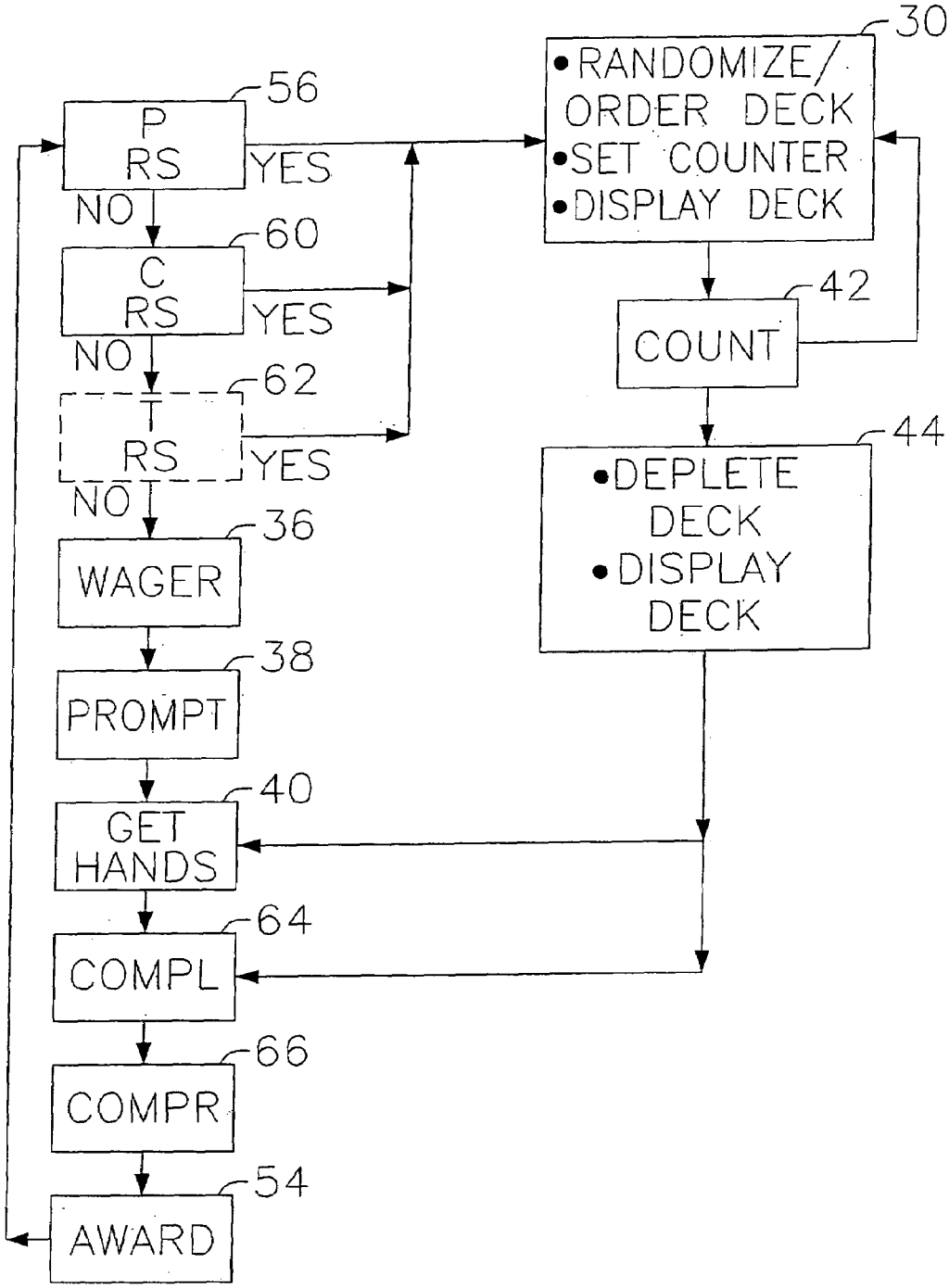
FIG. 4 illustrates a flowchart for the game of Blackjack or Baccarat.

Turning to FIG. 4, there is shown a diagram for the play of Blackjack or Baccarat according to the present invention. Like elements bear like reference numbers.

At 36 the player inputs their desired wager to play a hand of Baccarat or Blackjack and at 38 prompts the processor 15 for play. The processor 15 accesses the first data structure 30 to get the next cards at 40 in order from the random, serially arranged, deck data. For Blackjack, the processor would select and display two cards for a player hand and two cards for a dealer hand; however for the dealer hand, only one card is exposed. Thus, at 44, the deck data is depleted by four cards displayed for the initial holding and the constituency of the remaining deck is displayed at table 34.

With continuing reference to FIG. 4, the processor 15 also counts at 42 the number of cards (and/or hands of play, if desired) represented by the current hand as well as accounts for the value, and if desired suit, of the cards remaining in the deck data inventory of the first data structure 30. For Baccarat or Blackjack, suit is not important and hence may not be accounted for.

At 64 the hands are completed by the player standing, splitting, doubling down, taking a hit according to the rules of Blackjack. The player's action may require the selection and display of additional cards for the player hand. For additional cards requested by the player, at 44 and as described above, the deck data is selected in order from the serially arranged, randomized deck data, cards are counted at 42, at 44 the deck data is depleted and the new deck constituency is displayed. The dealer's hand at 64 is also completed which may require selecting and displaying additional cards according to the well-known rules of the game. For any additional cards for the dealer's hand, cards are counted at 42, at 44 the deck data is depleted and the new deck constituency is displayed.

When the player and dealer hands have been completed, at 66 the hands are compared, according to the well known rules of the game to determine if the player has won the hand. If the player has won at 54 the award is issued to the player and if not, the player's wager is lost and is retained.

After the award or if no award was won, the processor 15 determines at 56 if the player has prompted re-shuffling of the deck data of the first data structure 30. The player may prompt reconfiguration and reconstitution of the deck data of the first data structure 30 into data representing a shuffled, random, serially ordered full deck by touching shuffle button 58 (FIG. 1). The processor 15 reconfigures and reconstitutes the deck data of the first data structure 30 into data representing cards $N_1$–$N_{52}$ for the fifty-two card deck. The display 12 would also be controlled to show the constitution of the deck data at table 34. The player may command re-shuffling where the deck constitution, for the next hand of play, is not what the player desires, e.g. is completely depleted of Aces thus making a Blackjack impossible for the next hand.

If the player does not command re-shuffling, re-shuffling may be commanded based upon the count of the card data which has been displayed or additionally or alternatively, the number of hands which have been played since re-shuffling of the deck. According to the preferred embodiment, where penetration into the deck data or the number of hands of play reaches a predetermine number, the processor 15 commands reconfiguration and reconstitution of the deck data. For example, if the count exceeds 30 cards, e.g. ($N_1$–$N_{31}$), at 60 the deck data is reshuffled before the play of the next hand. Or, if four hands have been played, re-shuffling may be triggered.

Also one or more triggers at 62 may trigger re-shuffling and reconstitution of the deck. For example, where all the Aces have been depleted from the deck (making a Blackjack impossible), re-shuffling may be triggered before the play of the next hand.

Baccarat is played in the same manner as illustrated in FIG. 4 and described above. The difference is the exposure of all cards and the known draw rules for Baccarat to complete the Player and Banker hands therefore.

The device and method may also be applied to other casino card games such as modified Blackjack, Baccarat or Poker games. Further the method can also be employed in a table game using one or more decks of cards and a card reader to read cards as they are distributed to players.

While I have described certain embodiments of the present invention, it should be understood that it is subject to many modifications and changes without departing from the spirit and scope of the appended claims.

We claim:

1. An electronic device for playing a hands of a card game according to the rules thereof utilizing data representing a deck of N playing cards:

a first data structure storing data representing each playing card of said deck;

a processor, said processor configured to include means for randomly arranging said playing card data into a random, serial order;

a video display;

means for a player to make a wager and prompt play of the game;

said processor, in response to prompting, configured to select and display at said display data from said first data structure representing a predetermined number of cards selected in order from said arranged data inventory to define an initial holding;

a control device for completing said initial holding according to the rules thereof by at least one of (1) replacing at least one card of the initial holding or (2) selecting additional cards, said processor configured to select and display at said display from said first data structure data representing each replacement or additional cards selected in order from said arranged data to define a final outcome for the hand of play;

said processor configured to display at said display data corresponding to the remaining constituency of said deck data depleted of said displayed card data;

said processor further configured to display data that said depletion has eliminated a final outcome; and said processor configured to determine if said final outcome is a winning or losing outcome and to issue an award for a winning combination.

2. The device of claim 1 comprising said processor configured to display said data corresponding to said remaining constituency the deck data at the completion of each hand of play.

3. The device of claim 1 comprising displaying the constituency of the deck data after the selection and display of card data.

4. The device of claim 1 comprising a counter to count the number of card data selected and displayed during the play of a series of outcomes, said processor configured to, at a predetermined count X of cards and before the play of the next hand, reconstitute and, configure the deck data into a new, random, serial order of N card data.

5. The device of claim 1 comprising an input device to prompt reconstitution and reconfiguration of said deck data.

6. The device of claim 1 further comprising said processor configured to control the display to display the deck constituency data in a table.

7. A method for playing an electronic Video Poker game utilizing data representing a deck of N playing cards comprising:

providing a data processor including a first data structure storing data representing at least one deck of N playing cards according to the rules of the game:

configuring the playing card dab into a random, serial order;

a player making wagers and playing a series of hands;

for each hand of play, selecting data from the first data structure and displaying at an electronic display data representing an initial holding of playing cards defining an initial holding, said data selected in order from the serially arranged deck data;

selecting a card of the initial holding to replace, said processor for any selected card to replace selecting and displaying one or more cards selected in order for the serially arranged deck data to define a final outcome, card combination;

displaying the constituency of the deck data depleted of said displayed cards;

comparing said final outcome card combination to data stored in a second data structure representing winning outcome combinations and if a winning outcome combination has been obtained issuing an award ; and if said deletion of said deck has eliminated the availability of any winning outcome, displaying information of said elimination.

8. The method of claim 7 comprising displaying the constituency of the deck data at the completion of each hand of play.

9. The method of claim 7 comprising displaying the constituency of the deck data after the selection and display of card data.

10. The method of claim 7 comprising counting the number of card data selected and displayed during the play of a series of outcomes and at a predetermined count X and before the play of the next hand reconstituting and reconfiguring the deck data into a new, random, serial order of N card data.

11. The method of claim 10 comprising the player prompting reconstitution and reconfiguration of said deck data.

12. The method of claim 7 further comprising displaying the deck constituency data in a table.

13. The method of claim 12 further comprising displaying the deck constituency data in a table including the values and suits corresponding to said card data.

14. The method of claim 7 comprising counting the number of card data selected and displayed during the play of a series of outcomes and reconstituting and reconfiguring the deck data into a new, random, serial order of N card data before the play of the next hand in response to the first of (1) the display of a predetermined count X of card data or (2) the display of data representing a trigger.

15. The method of claim 7 comprising counting the number of card data selected and displayed during the play of a series of outcomes and reconstituting and reconfiguring the deck data into a new, random, serial order of N card data before the play of the next hand in response to the first of (1) the display of a predetermined count X of card data, (2) the display of data representing said trigger or (3) the player prompting reconstitution and reconfiguration.

16. The method of claim 7 further comprising configuring said processor to display a pay table corresponding to each winning outcome and the corresponding award and to reconfigured the displayed pay table where deck depletion eliminates a winning outcome.

17. An electronic device for playing a hands of a Video Poker game utilizing data representing a deck of N playing cards:

a first data structure storing data representing each playing card of said deck;

a processor, said processor configured to include means for randomly arranging said playing card data into a random, serial order;

a video display;

means for a player to make a wager and prompt play of the game;

said processor, in response to prompting, configured to select and display at said display data from said first data structure representing a predetermined number of cards selected in order from said arranged data inventory to define an initial holding;

a control device for the player to select from said initial holding at least one card to discard, said processor configured to select and display at said display from said first data structure data representing the cards selected in order from said arranged data a card to replace each discarded card and to define a final outcome for the hand of play; said processor configured to display at said display data corresponding to the remaining constituency of said deck data depleted of said displayed card data;

said processor configured to compare said outcome to a schedule of winning outcomes stored in a second data structure and to issue an award for a winning combination; and said processor further configured to display data that said depletion has eliminated a final outcome.

18. The device of claim 17 comprising said processor configured to display said data corresponding to said remaining constituency the deck data at the completion of each hand of play.

19. The device of claim 17 comprising displaying the constituency of the deck data after the selection and display of card data.

20. The device of claim 17 comprising a counter to count the number of card data selected and displayed during the play of a series of outcomes, said processor configured to, at a predetermined count X of cards and before the play of the next hand, reconstitute and reconfigured the deck data into a new, random, serial order of N card data.

21. The device of claim 20 comprising an input device to prompt reconstitution and reconfiguration of said deck data.

22. The device of claim 17 further comprising said processor configured to control the display to display the deck constituency data in a table.

23. The device of claim 22 further comprising said processor configured to control the display to display the deck constituency data in a table including the values and suits corresponding to said card data.

24. The device of claim 17 wherein said card data includes data representing a Joker and comprising a counter to count the number of card data selected and displayed during the play of a series of outcomes and said processor configured to reconstitute and reconfigured the deck data into a new, random, serial order of N card data before the play of the next hand in response to the first of the (1) display of a predetermined count X of card data or (2) the display of data representing said Joker.

25. The device of claim 17 comprising a counter to count the number of card data selected and displayed during The play of a series of outcomes , an input device and said processor configured to reconstitute and reconfigured the deck data into a new, random, serial order of N card data before the play of the next hand in response to the first of (1) the display of a predetermined count X of card data, (2) the display of data representing selected card data or (3) the input of a signal with said input device to prompt reconstitution and reconfiguration.

26. The device of claim 17 comprising said processor configured to display a pay table corresponding to each winning outcome and the corresponding award and to reconfigured the displayed pay table where deck depletion eliminates a winning outcome.

27. A method for playing a card game according to the rules thereof comprising:

(a) providing a data processor having a first data structure storing data representing each playing card of at least one deck of N playing cards used according to the rules of the game;

(b) a player making a wager to play a hand of the game and prompting play;

(c) according to the rules of the game, displaying cards randomly selected by the processor from the data structure to define an outcome for the hand;

(d) assessing the outcome for the hand to determine if the outcome is a winning outcome according to the predetermined rules of the game and if the outcome is a winning outcome issuing an award to the player;

(e) depleting the card data available for selection and display for subsequent selection and display of card data which has been previously selected and displayed;

(f) displaying information to the player of any winning outcomes eliminated by said depletion; and (g) to play subsequent hands repeating steps (b)–(f).

28. The method of claim 27 comprising displaying the constituency of the deck data available for selection and display at the completion of each hand of play.

29. The method of claim 27 comprising displaying the constituency of the deck data available for selection and display after the selection and display of card data.

30. The method of claim 27 comprising counting the number of card data selected and displayed during the play of a series of outcomes and at a predetermined count X and before the play of the next hand reconstituting the card data available for selection and display to N card data.

31. The method of claim 30 comprising the player prompting reconstitution and reconfiguration of said deck data.

32. The method of claim 27 comprising displaying the deck constituency data in a table.

33. The method of claim 32 further comprising displaying the deck constituency data in a table including the values and suits corresponding to said card data.

34. The method of claim 27 comprising counting the number of card data selected and displayed during the play of the series of hands and reconstituting the deck data available for selection and display to N card data before the play of the next hand in response to the first of (1) the display of a predetermined count X of card data or (2) the display of data representing a trigger.

35. The method of claim 27 comprising counting the number of card data selected and displayed during the play of a series of and reconstituting the deck data available for selection and display N card data before the play of the next hand in response to the first of (1) the display of a predetermined count X of card data, (2) the display of data representing said trigger or (3) the player prompting reconstitution of said deck data.

36. The method of claim 27 further comprising configuring said processor to display a pay table corresponding to each winning outcome and the corresponding award and to reconfigured the displayed pay table where deck depletion eliminates a winning outcome.

37. The method of claim 27 comprising at a predetermined depletion of said card data, reconstituting the deck data available to said data representing N cards.

38. The method of claim 37 comprising the player prior to making a wager prompting the processor to reconstitute the deck data available to data representing N cards.

39. The method of claim 27 comprising said game is Poker, displaying a winning outcome award schedule for predetermined winning Poker hand outcomes and where depletion of said data has eliminated the availability of an award from said schedule, indicating said elimination.

40. The method of claim 27 comprising configuring said card data into a random serial order of cards N and selecting and displaying said cards from said data structure for said hands serially from said deck data.

41. A method for playing a card game according to the rules thereof comprising:

(a) providing a data processor including a first data structure storing data representing at least one deck of N playing cards according to the rules of the game, said card data including data for said cards corresponding to value, the suit of Clubs, Diamonds, Hearts and Spades and where a Joker is included in N, data representing said Joker;

(b) a player making a wager to play each of a series of hands of play;

(c) for each hand of play, randomly selecting and displaying from said first data structure at an electronic display data representing an initial holding of at least two playing cards and completing the initial holding to a final holding according to the rules thereof by at least one of (1) displaying additional cards or (2) replacing selected cards, said processor for any additional or replaced card randomly selecting and displaying card data from said data structure to define said final outcome, card combination;

(d) displaying a tally corresponding to the constituency of the deck data of said data structure depleted of said cards displayed in the play of the preceding hands, said tally displaying the values and suits of said remaining constituent data including the display of any card values or suits which have been completely depleted;

(e) for each hand determining if the players final outcome is a winning or a losing outcome and issuing an award corresponding to a winning outcome; and (f) at one of (i) the selection and display of a predetermined trigger card or (ii) a predetermined depletion of said deck data, re-constituting the deck data representing N cards.

42. The method of claim 41 comprising displaying any outcomes rendered unavailable by depletion of said deck data.

43. A method for playing a card game according to the rules thereof and using an inventory of playing cards including the four suits of Clubs, Diamonds, Hearts and Spades the method comprising:

storing data representing each playing card;

the player making wagers to play a series of hands of the game, each hand of the series played by a processor selecting and displaying (1) an initial set of cards and (2) additional or replacement set of cards from said inventory to produce a final, concluding, outcome for the hand, excluding from selection and display data for cards which have been selected and displayed;

displaying data corresponding to a game outcome eliminated by said exclusion; and issuing an award to the player for any hand of the series having a predetermined winning final outcome.

44. The method of claim 43 comprising displaying to the player data corresponding to the values and suits of all cards remaining available for selection and display.

45. The method of claim 43 comprising reconstituting to a full compliment of card data upon the exclusion of card data representing a predetermined number of cards and before the play of the next hand.

46. electronic device for playing a card game according to the rules thereof and using an inventory of playing cards including the four suits of Clubs, Diamonds, Hearts and Spades the device comprising:

a data structure storing data representing each playing card;

a video display;

means for a player to input wagers to play a series of hands of the game;

a processor configured to select and display at said display (1) an initial set of cards and (2) additional or replacement set of cards from said inventory to produce a final, concluding, outcome for the hand, said processor configured to exclude from selection and display data for cards which have previously been selected and displayed and to displaying data corresponding to a game outcome eliminated by said exclusion; and said processor configured to determine if said outcome for the hand is a winning final outcome and if so to issue an award to the player.

47. The device of claim 46 comprising said processor configured to control the display to display the inventory of cards which have not been excluded.

* * * * *